US011117017B2

(12) United States Patent
Rayman

(10) Patent No.: US 11,117,017 B2
(45) Date of Patent: Sep. 14, 2021

(54) EXERCISE APPARATUS FOR AN ASSISTED SQUAT EXERCISE

(71) Applicant: Sculpted Partners LLC, New York, NY (US)

(72) Inventor: Erika Rayman, New York, NY (US)

(73) Assignee: Sculpted Partners LLC, New Yorkk, NY (US)

( * ) Notice: Subject to any disclaimer, the term of this patent is extended or adjusted under 35 U.S.C. 154(b) by 24 days.

(21) Appl. No.: 16/385,151

(22) Filed: Apr. 16, 2019

(65) Prior Publication Data

US 2019/0314677 A1 Oct. 17, 2019

Related U.S. Application Data

(60) Provisional application No. 62/658,697, filed on Apr. 17, 2018.

(51) Int. Cl.

| | |
|---|---|
| ***A63B 23/04*** | (2006.01) |
| ***A63B 21/062*** | (2006.01) |
| ***A63B 21/00*** | (2006.01) |

(52) U.S. Cl.

CPC .... *A63B 23/0405* (2013.01); *A63B 21/00181* (2013.01); *A63B 21/0628* (2015.10); *A63B 21/4035* (2015.10); *A63B 21/4047* (2015.10); *A63B 2023/0411* (2013.01); *A63B 2225/093* (2013.01)

(58) Field of Classification Search

CPC ..... A63B 21/00058; A63B 21/00065; A63B 21/00069; A63B 21/00072; A63B 21/06; A63B 21/062; A63B 21/0626; A63B 21/0628; A63B 21/063; A63B 21/0632; A63B 21/15; A63B 21/151; A63B 21/154; A63B 21/155; A63B 21/159; A63B 21/4027; A63B 21/4033; A63B 21/4034; A63B 21/4035; A63B 21/4039; A63B 21/4041; A63B 21/4045; A63B 21/4047; A63B 21/4049; A63B 23/0233; A63B 23/0238; A63B 23/035; A63B 23/04; A63B 23/0405; A63B 2023/0411; A63B 2225/093

See application file for complete search history.

(56) References Cited

U.S. PATENT DOCUMENTS

| | | | | |
|---|---|---|---|---|
| 2,201,036 A | | 2/1939 | Guerrier | |
| 4,500,089 A | * | 2/1985 | Jones | A63B 21/00072 482/100 |

(Continued)

*Primary Examiner* — Garrett K Atkinson
*Assistant Examiner* — Zachary T Moore
(74) *Attorney, Agent, or Firm* — Ladas & Parry LLP

(57) ABSTRACT

An apparatus for a squat exercise comprises a user buttocks pad supported by a pivotally mounted arm for rotation in a vertical plane to allow the user to perform the exercise while in contact with the buttocks pad. The arm length and initial angular position with respect to the horizontal being adjustable. Hand grips are provided for engagement by the user during the exercise. A weight stack is operatively connected to the arm for providing a resistive force as the user squats and an assisting force as the user rises hack to the starting position. A footrest is positioned to maintain the feet of the user to allow the weight of the user to be directed through the heels during the exercise. A base supports a pivot for the arm, as well as the weight stack and footrest.

9 Claims, 3 Drawing Sheets

(56) References Cited

U.S. PATENT DOCUMENTS

| | | | | | |
|---|---|---|---|---|---|
| 4,600,189 | A * | 7/1986 | Olschansky | A63B 21/00072 | 482/100 |
| 4,618,140 | A | 10/1986 | Brown | | |
| 4,621,807 | A * | 11/1986 | Stramer | A63B 21/06 | 482/100 |
| 4,627,616 | A * | 12/1986 | Kauffman | A63B 21/154 | 181/141 |
| 5,201,694 | A | 4/1993 | Zappel | | |
| 5,554,086 | A * | 9/1996 | Habing | A63B 23/03525 | 482/100 |
| 5,643,147 | A | 7/1997 | Huang | | |
| 7,247,128 | B2 | 7/2007 | Oga | | |
| 7,452,311 | B2 | 11/2008 | Barnes | | |
| 9,375,607 | B1 | 6/2016 | Rayman et al. | | |
| 2003/0092541 | A1* | 5/2003 | Giannelli | A63B 23/0233 | 482/99 |
| 2008/0020911 | A1* | 1/2008 | Castello Neto | A63B 21/4047 | 482/100 |
| 2008/0039298 | A1* | 2/2008 | Steinmetz | A63B 23/0405 | 482/101 |
| 2011/0275497 | A1* | 11/2011 | Lorusso | A63B 23/0405 | 482/139 |
| 2012/0058866 | A1 | 3/2012 | Hongo | | |
| 2013/0324374 | A1* | 12/2013 | Ellis | A63B 21/1609 | 482/97 |
| 2016/0082315 | A1* | 3/2016 | Carter | A63B 21/0628 | 482/94 |
| 2016/0175645 | A1* | 6/2016 | Rayman | A63B 21/4047 | 482/131 |
| 2017/0319905 | A1* | 11/2017 | O'Connor | A63B 21/0628 | |

* cited by examiner

EXERCISE APPARATUS FOR AN ASSISTED SQUAT EXERCISE

The present invention relates to a new and improved exercise apparatus and particularly to such type of apparatus that is manually operated and targets the gluteus muscle group.

BACKGROUND OF THE INVENTION

The three main muscles of the human gluteus group, the gluteus maximus, media and minimus (the "glutes") make up the buttocks, and are important as they serve to maintain the trunk in an erect posture. Among other actions, they allow the body to regain an erect position after stooping and also collectively act as a rotator of the legs. They are involved in numerous sports, particularly where running is involved. In addition, a well-formed buttocks, especially in women, is typically viewed as an integral part of an attractive appearance.

Numerous exercises, including squats and lunges, target the gluteus muscles. These exercises, which traditionally rely upon the carrying of a barbell on the shoulders of the individual, require some level of dexterity and balance, as well as strength to lift the barbell into position. It may be uncomfortable for the user to support and maintain the weights in the proper position. For effective exercise, proper form is required. Exercise devices, such as a power cage or an upright frame known as a Smith machine, can be used to perform squats, and allow the weights to travel vertically along a predetermined path, preventing the barbell from moving forwards, backwards or sideways.

In the present applicant's U.S. Pat. No. 9,375,607 a portable apparatus for exercising the glutes is set forth and described. That apparatus, however, does not necessarily have the type of construction that makes it suitable for commercial-type use, such as in a gym. It also may have a limited range of resistance, making it difficult to adapt to a plurality of users.

BRIEF DESCRIPTION OF THE INVENTION

The present invention is directed to an exercise apparatus of the general type in which the user is supported by the apparatus to perform a squatting maneuver, the device allowing control over both the squatting maneuver and return of the user to the upright position. It represents a modification over the device of the '607 patent, in that it provides, inter alia, for a weight stack resistance system and a frame construction that offers increased stability, improved user-specific configuration, and improved user ingress/egress.

The exercise apparatus of the invention comprises a buttocks support pad mounted to an arm. The arm is pivotally attached to the unit's frame through an upright. The initial angular position and length of the arm may be adjustable to accommodate users of differing heights/leg length. The frame supports a weight stack, which is connected to the arm and biases the arm into a starting position and provides resistance to the squatting exercise motion of the user, as well as providing a return mechanism for the arm as the user rises from the squatting position. The weight stack is adjustable, and is preferably operatively connected to the arm by a cable system. The support pad arm is constructed to position the pad in front of a pair of hand grips, which themselves are preferably positioned between the pad and the weight stack. An angled foot ramp is positioned for support of the user's feet, dimensioned to keep the user's heels on the floor while elevating the forward portion of the feet.

BRIEF DESCRIPTION OF THE DRAWINGS

A fuller understanding of the present invention will be achieved upon consideration of the following detailed description of an illustrative embodiment of the invention, when reviewed in conjunction with the annexed figures wherein.

DETAILED DESCRIPTION OF THE INVENTION

Figure 1:
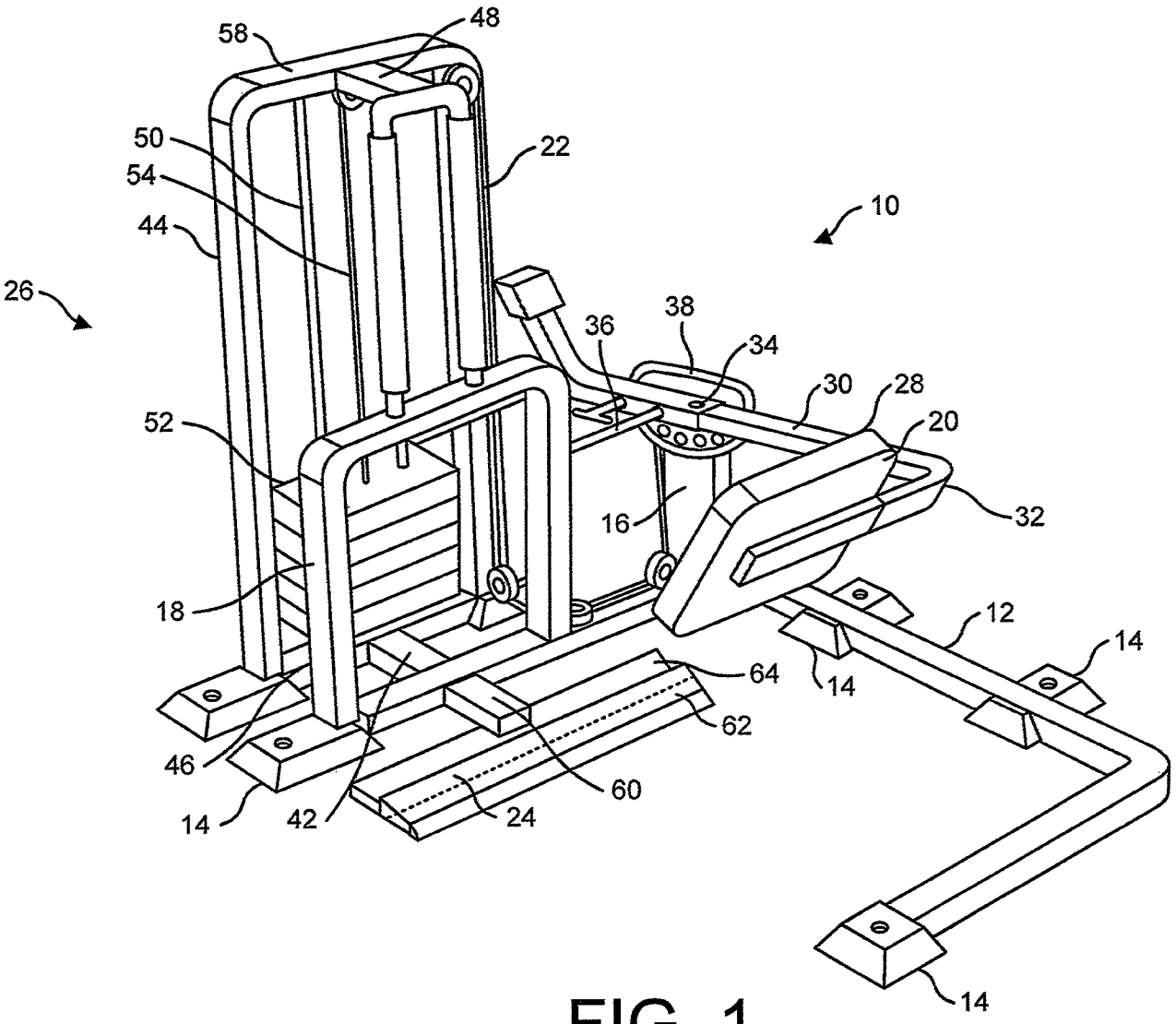
FIG. 1 is a perspective view of the invention.
Figure 2:
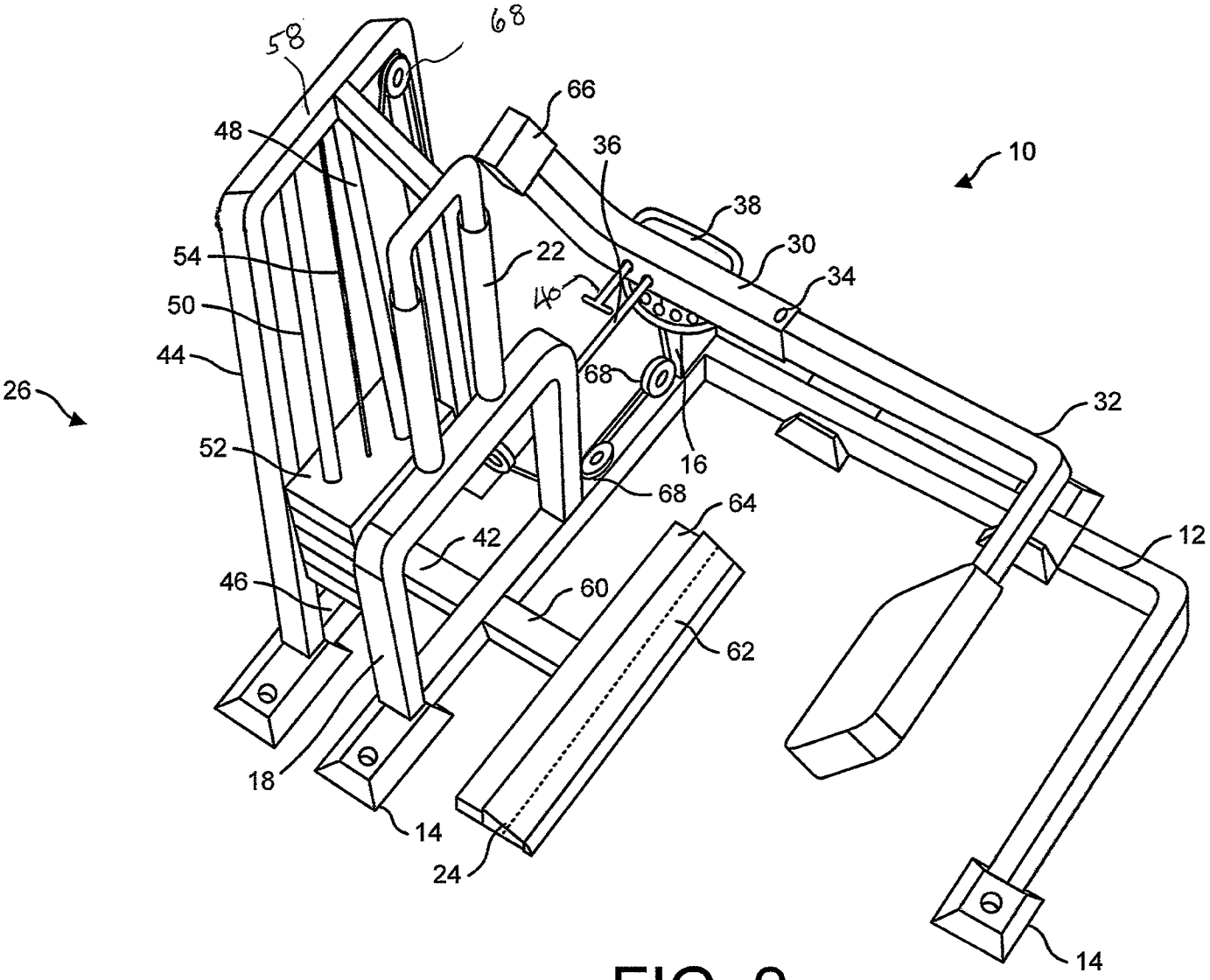
FIG. 2 is an overhead perspective view of the invention.
Figure 3:
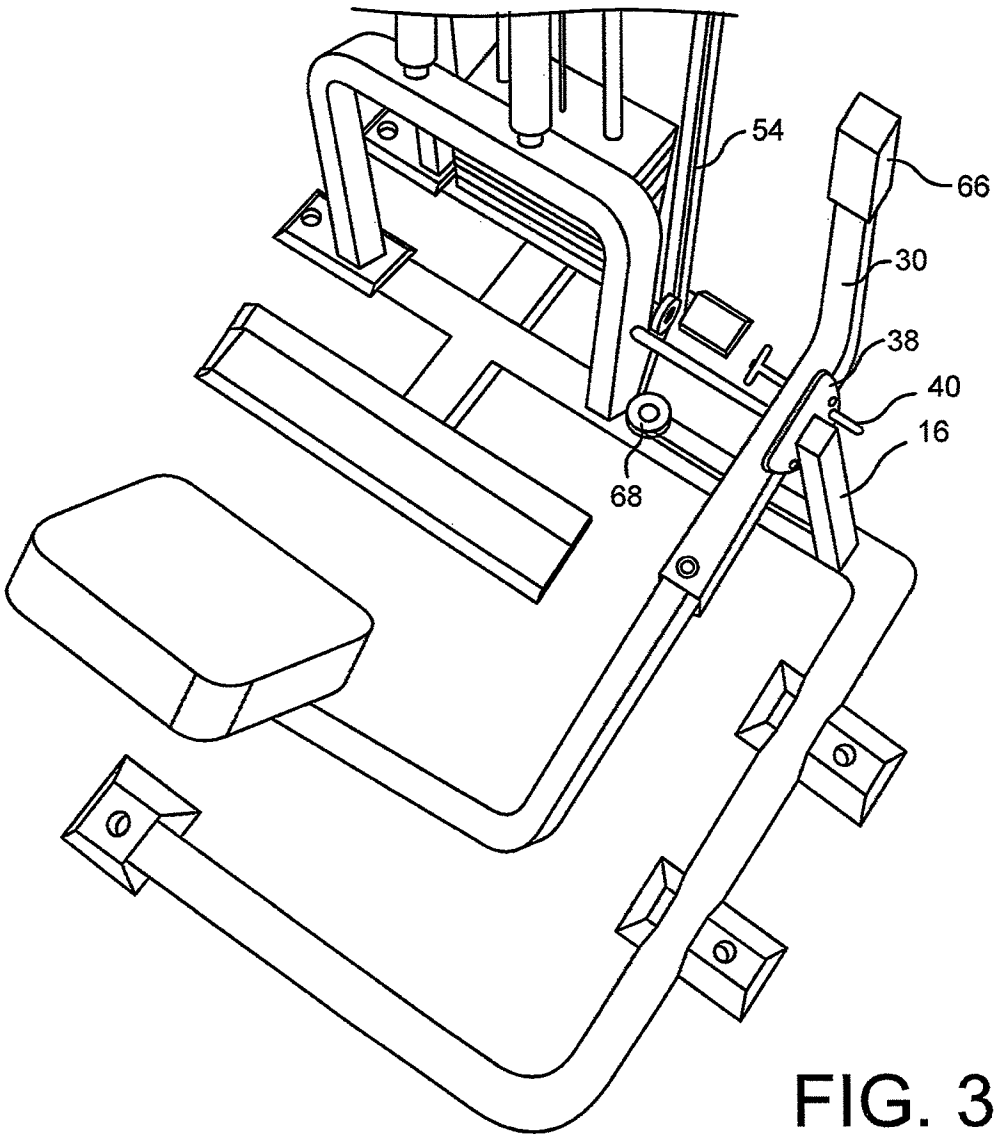
FIG. 3 is an overhead perspective view detailing the cable connection between the weight stack and arm.

As seen in drawings, and particularly FIGS. 1 and 2, exercise apparatus 10 comprises a generally u-shaped main base 12 with resilient pads 14 as known in the art to provide a slip-resistant contact with the floor upon which the base sits. The base, as well as the overall frame-forming elements attached thereto, may be constructed of appropriate metal stock, such as steel tubing. Base 12 supports both stub upright 16 about which buttocks pad arm assembly 20 is journalled, and vertical inverted u-frame member 18 from which handgrip assembly 22 extend upwardly. The handgrip-assembly may comprise a pair of separate vertical elements, or preferably an inverted U element as depicted in the figures. Alternatively the handgrips may be oriented horizontally upon a single or pair of vertical elements, with height adjustment means. The handgrips themselves may comprise an appropriate resilient material coating for the underlying metal element. Horizontal stub beams 60, 42 respectively extend forwardly and rearwardly from the portion of the base 12 between the legs of u-frame 18, and connect foot rest 24 and weight stack assembly 26 to the base.

Seat arm assembly 20 comprises buttocks pad 28 mounted to seat arm 30. As may be seen, seat arm 30 includes right-angle portion 32 to which the pad is affixed. While the main portion of the arm is offset laterally from the weight stack assembly, handgrips and foot rest, the distal end of portion 32 positions the pad, and thus the user, in line with the handgrips and foot rest. The horizontal spacing between the pad and the handgrips and foot rest may be adjusted to accommodate different height users by a telescope joint as known in the art between the right angle portion 32 and the main portion of the seat arm, with locking pin 34 maintaining the positioning. Right-angle end portion 32 may also be formed such that the pad 28 is at an appropriate angle, typically in the range of 0 to 60 degrees to the horizontal, when the arm is in a starting position. The precise angle is not crucial, so long as it allows the user to be in contact with the seat as the exercise movement is performed.

The seat arm 30 is pivotally mounted in a vertical plane about an axis formed by axle 36, preferably extending between a leg of u-frame 18 and stub upright 16. As illustrated in the figures, the initial angle of the seat arm with respect to the horizontal is controlled by positioning cam 38, also journalled about the axle. The cam is provided with a series of bores for locking pin 40, while the seat arm is provided with a bore that can align with a chosen one of the cam bores, locking the seat arm to the cam and allowing the initial angular orientation of the seat arm to be chosen by rotating the arm about the axle axis and inserting the locking pin through the seat arm bore and the appropriate cam bore. Counterweight 66 may be provided to counterbalance the weight of the buttocks pad and arm. Adjustment of the seat arm's initial angle, in combination the horizontal spacing of the seat from the foot rest by the telescope joint, allows accommodation of users of varying heights and leg/torso proportions, such that the user's buttocks rest against the seat with the arms in a fully extended position when gripping the hand grips.

Weight stack assembly 26 comprises inverted-U frame 44 extending upwardly from base beam 46. Stub 42 joins the base beam 46 to main base 12, while upper stub 48 joins the central, horizontal portion 58 of frame 44 to the upper end of handgrips 22. Weight stack 52 sits between the legs of frame 44, and may rest when in a lowered position on base beam 46. The individual weights of the stack may be provided with a pair of bores to allow the weights to be travel vertically along guide bars 50, which extend between the base pad and the frame central portion 58. The weight stack is connected to the seat arm assembly by cable 54, led by pulleys 68 positioned along the unit as appropriate, whereby, as the seat arm pivots clockwise in FIG. 1, cable 54 lifts the attached weight stack. Preferably, the cable is connected to the distal end of pivoting cam 38, whereby as the seat arm assembly rotates, the cable is wound about the periphery of the cam. With the weight stack in the initial, fully lowered position, the length of the cable is such that it maintains the cam in a generally fixed initial rotative position, facilitating the pinning of the seat arm to the cam in the chosen initial angular position of the seat arm. The cam may be dimensioned and sized to provide a desired mechanical advantage to the arm assembly as it rotates, and may further be contoured along its periphery about which the cable is wound to vary the mechanical advantage through the desired degree of rotation. The weight stack may be provided with an adjustment system as known in the art to vary the amount of weight to be lifted by the cable in response to motion of the seat arm. The adjustment system may comprise, for example, the cable being affixed to the top-most weight, with an attachment mean, such as a depending rod with bores aligned with corresponding bores in the individual weights, to allow selective engagement through a pin inserted in a weight bore to operatively connect the cable to that weight and those stacked above it.

Foot rest 24, connected to main frame 14 by stub 60, comprises angled ramp portion 62 and platform portion 64. The ramp may define an angle in the range of 30 to 50 degrees with the floor, and has a front-to-back width sufficient to support the forward portion of the user's feet, with the heels remaining on the floor. The ramp insures that the weight of the user is directed to, and remains over, the heels of the feet during exercise motion. The foot rest may be of a unitary construction with a side-to-side length sufficient to support both feet, or may comprise a pair of individual foot rest elements, which may be further provided with means for varying their separation for the comfort of the user.

A user of the apparatus positions herself with the buttocks supported upon pad 28, hands holding the handgrips 22, and feet on the footrest 64, with the heels on the floor. The distance between the buttocks pad and the handgrips 22 is adjusted through the telescope joint of the seat arm 30 and the positioning cam 38 such that the user's arms are substantially extended to maintain the user in an erect position with the buttocks resting against the pad. The offset position of the seat arm allows entry of the user into the operating position from the unobstructed opposite side of the unit. The positioning of the user against the pad requires the user to maintain her position on the pad by tensing the leg and buttocks muscles, rather than simply sitting in a relaxed position on the pad. The positioning of the feet direct the user's weight to and through the heels, thus also causing tension to the leg and buttocks muscle groups.

The user squats down in a controlled, slow manner, the concurrent lifting of the weight stack providing an opposing force, assisting in controlling the descent speed, the user exercising the glutes to effect the desired controlled descent. From a lowered position the user rises up, the lowering of the weight stack assisting the user and again allowing her rise to be in a slow and controlled manner, the glutes being further exercised.

I claim:

1. An exercise apparatus for a squat exercise to be performed by a user, the squat exercise comprising the performance of a squat and return to an upright position, the exercise apparatus comprising:

a flat user buttocks pad supported by an arm pivotally mounted for rotation in a vertical plane about an arm upright adapted to allow the user to perform the exercise with the buttocks in contact with the user buttocks pad throughout the complete performance of the squat exercise, a length of the arm and its initial angular position with respect to a horizontal being adjustable;

fixed position user hand grips for engagement by the user during the exercise;

a weight stack operatively connected to the arm for providing a resistive force to the rotation of the arm in a first direction when the user performs the squat and an assisting force to the rotation of the arm in a second direction when the user returns to the upright position;

a footrest comprising an upwardly-angled ramp portion with respect to a facing (position of the user when performing the squat for supporting a forward portion of the user's feet in a raised position with respect to the heels of the user such that heels of the user are positioned whereby a weight of the user is directed through the heels to a supporting surface for the user's feet with the user adapted to rest against the user buttocks pad during the exercise; and a base for supporting the arm upright, weight stack and footrest.

2. The exercise apparatus of claim 1 wherein the arm comprises a main portion pivotally mounted to the arm upright and a right-angle portion to which the user buttocks pad is mounted.

3. The exercise apparatus of claim 2 wherein the right-angle portion of the arm is dimensioned to align the user buttocks pad with the hand grips and footrest, the main portion being laterally offset therefrom.

4. The exercise system of claim 2 wherein the main portion of the arm includes a portion extending forwardly of the arm upright which supports a counterweight.

5. The exercise apparatus of claim 1 wherein the weight stack is connected to the arm by a cable affixed to a rotatable cam.

6. The exercise apparatus of claim 5 wherein the rotatable cam and the arm are journaled about an axle mounted to the arm upright, the cam and arm being mutually engageable to operatively connect the weight stack to the arm.

7. The exercise apparatus of claim 6, wherein an initial angular position of the arm about the axle with respect to the rotatable cam is adjustable.

8. The exercise apparatus of claim 7 wherein the initial angular position is established by a pin and multiple bore locking system.

9. The exercise apparatus of claim 5 wherein the cable is affixed to the rotatable cam such that the cable is wound about a periphery portion of the cam as the cam rotates from an initial position.

* * * * *